United States Patent [19]

Feess et al.

[11] 3,972,677

[45] Aug. 3, 1976

[54] PROCESS FOR THE PREPARATION OF DISCHARGE EFFECTS ON DYEINGS OR PRINTS MADE WITH DISPERSE DYES ON FLAT-SURFACE TEXTILE STRUCTURES OF SYNTHETIC FIBERS

[75] Inventors: Erich Feess, Lorsbach, Taunus; Heinz Dethloff, Frankfurt am Main, both of Germany

[73] Assignee: Hoechst Aktiengesellschaft, Frankfurt am Main, Germany

[22] Filed: Mar. 21, 1974

[21] Appl. No.: 453,530

[30] Foreign Application Priority Data

Mar. 23, 1973 Germany ..... 2314541

[52] U.S. Cl. ..... 8/69

[51] Int. Cl.[2] ..... D06P 5/00

[58] Field of Search ..... 8/69

[56] References Cited

UNITED STATES PATENTS

| | | | |
|---|---|---|---|
| 1,914,536 | 6/1933 | Smith | 8/69 |
| 2,248,128 | 7/1941 | Seymour et al. | 8/69 |
| 3,103,404 | 9/1963 | Salvin et al. | 8/69 |

OTHER PUBLICATIONS

Bernardy et al., Melliand Textilberichte, vol. 39 (1958), pp. 292–297.

*Primary Examiner*—M. J. Welsh

*Attorney, Agent, or Firm*—Curtis, Morris & Safford

[57] ABSTRACT

Process for the preparation of discharge effects under or on dyeings or prints with disperse dyes on flat-surface textile structures made of synthetic fibers, which process comprises applying to the textile material a dyeing by padding, slop-padding or printing dischargeable disperse dyes and drying at mild temperatures, printing on the dyeing which has not yet been fixed a discharge paste containing discharge-resistent disperse dyes and fixing that paste after intermediate drying either by a steaming process in saturated steam followed by a treatment with dry heat or a treatment with over-heated steam, or by steaming in pressurized steam.

3 Claims, No Drawings

PROCESS FOR THE PREPARATION OF DISCHARGE EFFECTS ON DYEINGS OR PRINTS MADE WITH DISPERSE DYES ON FLAT-SURFACE TEXTILE STRUCTURES OF SYNTHETIC FIBERS

The present invention relates to a process for the preparation of discharge effects on dyeings or prints made with disperse dyes on flat-surface textile structures of synthetic fibers.

It is known that discharge effects can be obtained on synthetic fibers dyed with disperse dyes by primarily dyeing the substrate with disperse dyes according to the usual dyeing methods, fully fixing the dyeing and then printing thereon a white and color discharge paste according to known prescriptions, fixing and after-treating them in known manner. To prepare the color discharges, such a dyeing which is already fully fixed, requires relatively high amounts of discharge agent, for example, zincsulfoxylate-formaldehyde. It is practically impossible to make available a broad palette of disperse dyes which are stable towards these amounts of discharge agent. Generally, only a small number of yellow disperse dyes is usable for this purpose.

The present invention provides a process for the preparation of discharge effects under or on dyeings or prints made with disperse dyes on flat-surface textile structures of synthetic fibers, in which process a dyeing is applied to the textile material by padding, slop-padding or printing with dischargeable disperse dyes and dried at mild temperatures, then a discharge paste containing discharge-resistant disperse dyes is printed on the dyeing which is not yet fixed and that paste is fixed after intermediate drying either by a steaming process using saturated steam followed by a treatment with dry heat or with overheated steam at 170° - 190°C, or by steaming in pressurized steam at 1.5–2.5 atmg.

By varying the operational method described above, the discharge printing paste can also be applied to the pre-dyed material output prior intermediate drying. Likewise, the process can be varied in such a manner, that the discharge printing paste is pre-printed and the ground dyeing is applied thereto after or without intermediate drying. According to that method, interesting conversion styles can also be prepared by applying dyestuff mixtures of dyestuffs dischargeable and discharge-resistant under the conditions hereinbefore mentioned and over-printing them with a white discharge material containing no dyestuff or pre-printing them before their application. That overprinting process can be carried out in a wet-in-wet operation or, also, after intermediate drying. Fixation is carried out as indicated above.

Suitable flat-surface textile structures of synthetic fibers, especially woven and knitted fabrics, for this invention are all materials which can be dyed by disperse dyestuffs, especially those of polyester, cellulose triacetate, cellulose-2 ½ acetate and polyamide fibers.

Suitable disperse dyestuffs for the preparation of color discharges and ground dyeings according to the process of the invention are all compounds which are known under that term and are suitable for being applied to the textile materials indicated above, for example, those of the azo and anthraquinone series. Suitable thickening agents are practically all those which are stable towards the additives in the discharge pastes.

The printing pastes contain as discharge agents formaldehyde-sulfoxylate, acetaldehyde-sulfoxylate or tin salts. Moreover, fixing accelerators, glycols or thiodiglycol and anthraquinone must be added. When sulfoxylates are used, the effect is still more improved by formaldehyde, urea and melamine ether.

The padding solution for the ground dyeing contains, beside the dyestuff, slight amounts of thickening substances, fixing accelerators and weak oxidation agents, for example, the sodium salt of the m-nitrobenzenesulfonic acid, and, optionally, weak organic acids, for example, citric acid or tartaric acid or acidic salts, for example, monosodium phosphate.

The process of the invention allows to make available a broad palette of disperse dyes discharge-resistent under these conditions using only slight amounts of discharge agents, about one-third of the usual amount, which dyes offer a color scale from yellow to black. Moreover, predyeing can be effected with dyestuffs which are normally considered being not enough dischargeable. In addition to these technical advantages, the process of the invention includes economical advantages which lie in the fact that the discharge colors are fixed together with the dyeing to be discharged and the dyeing need not be fixed before at high costs.

The following examples illustrate the invention without limiting it thereto, the parts being by weight unless stated otherwise.

The Color-Index-Numbers indicated in the examples with reference to the dyestuffs used have been quoted from the 3rd edition, 1971

EXAMPLE 1:

50 Parts of the liquid commercial form of the disperse dye having the following constitution

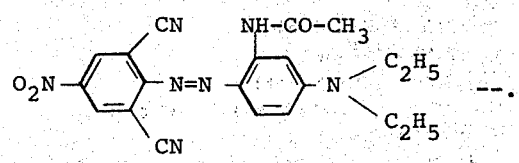

--.

were diluted with

200 Parts of water.

100 Parts of a 10 % alginate thickening of low viscosity were added, wherein

5 Parts of meta-nitrobenzenesulfonic acid sodium and

5 Parts of monosodium phosphate were introduced.

20 Parts of a fixing accelerator consisting of 35 parts of a reaction product of 1 mol of diphenylol propane and 30 mols of ethylene oxide, 60 parts of polyehtyleneglycol (molar weight 400) and 5 parts of a reaction product of 1 mol of stearyl alcohol with 7 mols of ethylene oxide were added. The whole was diluted with water to 1000 Parts.

That solution was applied to a polyester fabric on a tworoller padding machine and dried at 80°C in the hotflue.

50 Parts of the liquid commercial form of the disperse dye having the following constitution

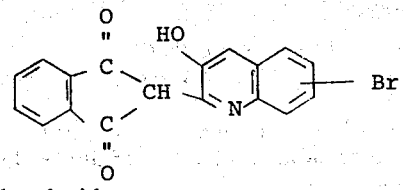

--.

were diluted with

200 Parts of water and
450 Parts of a 10 % locust bean flour ether thickening were added.
5 Parts of monosodium phosphate were dissolved in that paste and
60 Parts of zinc oxymethane sulfinic acid (primary salt) were added.
15 Parts of formaldehyde,
20 Parts of thiodiglycol,
30 Parts of anthraquinone,
10 Parts of hexamethylolmelamine ether and
20 Parts of the fixing accelerator mentioned above were introduced while stirring
140 Parts of water were used to make up the solution to 1000 parts.

This printing paste was printed on a polyester fabric previously padded and dried by means of a film screen according to design.

To destroy the ground dyeing, the fabric was steamed with saturated steam for 8 minutes, and then treated on the tenter frame with dry heat at 195°C during 50 seconds. It was after-treated and finished in known manner. By proceeding in this manner, a clear, yellow discharge effect was obtained on a blue ground.

EXAMPLE 2

50 Parts of the liquid commercial form of the disperse dye C.I. Disperse Red 60/Color Index No. 60756 were diluted with
200 Parts of water and introduced in
500 Parts of a 10% locust bean flour ether thickening.
70 Parts of zinc oxymethanesulfinic acid (primary salt),
15 Parts of formaldehyde,
20 Parts of thiodiglycol,
30 Parts of anthraquinone,
10 Parts of hexamethylolmelamine ether,
30 Parts of urea and
20 Parts of a fixing accelerator (indicated in Example 1) were introduced while stirring. The mixture was diluted with 55 parts of water to 1000 parts. This color discharge paste was printed on a polyester fabric by means of a print roller according to design. A ground color was cross-printed at the same time, in overlapping manner without intermediate drying by means of a finely engraved roller. The ground color had the following composition:
30 Parts of the liquid commercial form of the disperse dye constituted as follows:

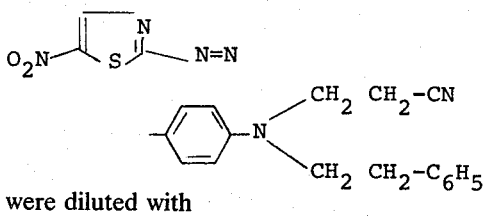

--.

were diluted with
200 Parts of water and introduced, while stirring, in
400 Parts of a 10% alginate thickening of low viscosity.
5 Parts of monosodium phosphate,
5 Parts of sodium meta-nitrobenzenesulfonic acid and
15 Parts of a fixing accelerator consisting of 35 parts of a reaction product of 1 mol of diphenylol propane and 30 mols of ethylene oxide, 60 parts of polyethyleneglycol
(molar weight 400) and 5 parts of a reaction product of
1 mol of stearyl alcohol and 9 mols of ethylene oxide were introduced in that paste, which was diluted with 345 parts of water to 1000 parts.

After drying, the fabric was steamed with saturated steam during 5 minutes and the paste was fixed during 6 minutes in overheated steam of 180°C. After-treatment and finishing followed in the usual manner.

A clear red discharge effect on violet ground was so obtained.

EXAMPLE 3

A dyestuff mixture was padded with a two-roller padding machine on a fabric made of unsaponified cellulose triacetate, the dyestuff preparation having the following composition:
40 Parts of the liquid commercial form of the disperse dye being constituted as follows:

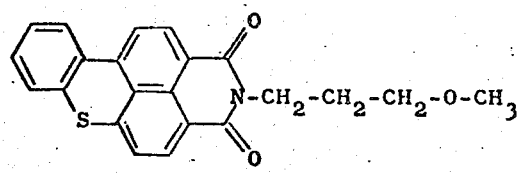

and
15 Parts of the liquid commercial form of the monoazo disperse dyestuff indicated in Example 1 were diluted with
200 Parts of water and introduced in
100 Parts of a 10% alginate thickening of low viscosity.
3 Parts of citric acid,
5 Parts of sodium meta-nitrobenzenesulfonic acid and
10 Parts of a fixing accelerator consisting of 30 parts of the reaction product of 1 mol of diphenylol propane and 30 mols of ethylene oxide, 60 parts of polyethyleneglycol (molar weight 600) and 5 parts of the reaction product of 1 of stearyl alcohol and 9 mols of ethylene oxide were added. The mixture was diluted with
637 parts of water to 1000 parts.

After drying at about 100°C a discharge paste was applied to the textile material so treated by means of film screen according to design, which paste was prepared as follows:
90 Parts of zinc oxymethanesulfinic acid,
15 Parts of formaldehyde,
30 Parts of anthraquinone and
20 Parts of thiodiglycol were introduced in 500 parts of a 10% locust bean flour ether thickening and this paste was diluted with
345 Parts of water to 1000 parts.

After drying, the textile material was steamed with saturated steam for 8 minutes and subsequently fixed in overheated steam at 175°C during 5 minutes.

A yellow discharge effect on a green ground was so obtained.

EXAMPLE 4

A discharge paste was printed on a polyester fabric using a roller engraved according to design, the paste being prepared as described in Example 3. Thereafter, it was crossprinted with a printing paste in overlapping manner and without intermediate drying using a roller according to design. That printing past had the following composition:

20 Parts of the liquid commercial form of the disperse dyestuff C.I. Disperse Violet 31/Color Index No. 62025 and 40 Parts of the liquid commercial form of the monoazodispersed dyestuff described in Example 1 as well as 10 Parts of the liquid commercial form of the disperse dyestuff C.I. Disperse Orange 13/Color Index No. 26080 were diulted with 200 Parts of a 10% alignated thickening of low viscosity.

3 Parts of tartric acid,

5 Parts of sodium meta-nitrobenzenesulfonic acid and

15 Parts of a fixing accelerator consisting of 35 parts of the reaction product of 1 mol of diphenylol propane and 30 mols of ethylene oxide, 60 parts of polyethyleneglycol (molar weight 400) and 5 parts of the reaction product of 1 mol of stearyl alcohol and 9 mols of ethylene oxide were introducded while stirring and the mixture was diluted with 207 Parts of water to 1000 parts.

After drying, the material was steamed with saturated steam during 6 minutes and then heated with dry heat at 200°C during 40 seconds. After-treating and finishing followed in the known manner. A red-violet color discharge effect on a dark blue ground was so obtained.

EXAMPLE 5

A dyestuff preparation having the composition indicated below was padded on a polyester fabric by means of a tworoller padding machine:

50 Parts of the liquid commercial form of the disperse dyestuff having the constitution

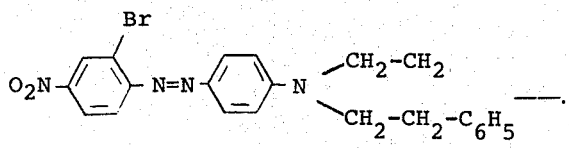

were diluted with

200 Parts of water and introduced in

100 Parts of a 10% alginate thickening of low visocity, while stirring.

5 Parts of monosodium phosphate,

5 Parts of sodium meta-nitrobenzenesulfonic acid and

15 Parts of a fixing accelerator consisting of 35 parts of the reaction product of 1 mol of diphenylol propane and 30 mols of ethylene oxide, 60 parts of polyethyleneglycol (molar weight 400) and 5 parts of the reaction product of 1 mol of stearyl alcohol and 9 mols of ethylene oxide. This mixture was diluted with 625 Parts of water to 1000 parts.

After drying at about 80°C a printing paste being composed as follows was printed on the material by means of a film screen according to design:

50 Parts of the liquid commercial form of the disperse dyestuff having the constitution

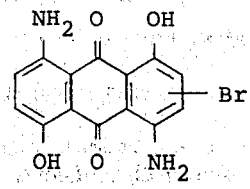

200 Parts off water,

500 Parts of a 8% thickening of locust bean flour ether,

70 Parts of stannous chloride,

30 Parts of thiodiglycol and

130 Parts of water as well as

20 Parts of fixing accelerator as indicated with reference to the ground dyeing.

After printing and drying, the material was steamed in a star steamer for 20 minutes under 1.5 atmg, aftertreated and finished in known manner.

A blue discharge effect on red ground was so obtained.

EXAMPLE 6

A dyestuff preparation having the following composition was padded on a fabric of cellulose-2½-acetate by means of a two-roller padding machine:

60 Parts of the liquid commercial form of the disperse dyestuff C.I. Disperse Orange 13/Color Index No. 26080, 200 Parts of water, 100 Parts of a 10% alginate thickening of low viscosity, 5 Parts of monosodium phosphate, 5 Parts of sodium meta-nitrobenzenesulfonic acid and 630 Parts of water.

After drying at about 80°C a printing-paste having the following composition was cross-printed using a film screen according to design:

60 Parts of the liquid commercial form of the disperse dyestuff C.I. Disperse Red 60/Color Index No. 60756, 200 Parts of water, 500 Parts of a 12% locust bean flour ether thickening, 70 Parts of zinc oxymethanesulfinic acid, 30 Parts of anthraquinone, 20 Parts of thiodiglycol, 30 parts of urea and 90 Parts of water.

After drying, the material was steamed for 30 minutes under normal atmospheric pressure in a star steamer and aftertreated in known manner. A red color discharge effect on yellow brown ground was so obtained.

We claim:

1. A process for the preparation of discharge effects on flat-surface textile structures made of synthethic fibers which comprises: applying to the textile material, as a first step, a dyeing with dischargeable disperse dyes or a mixture of dischargeable and discharge-resistant disperse dyestuffs, by padding, slop-padding or printing; thereafter, without intermediate drying or with drying at mild temperatures whereby no fixing occurs, as a second step, printing on the said dyeing a discharge paste which contains a discharge-resistant disperse dyestuff if the said dyeing did not apply a discharge-resistant dye; and as a third step fixing the dyeings by a. either a steaming process in saturated steam followed by (1) a treatment with dry heat or (2) a treatment with superheated steam at 170 to 190°C, or b. steaming in pressurized steam under 1.5 – 2.5 atmg.

2. Process as claimed in claim 1, wherein a discharge printing paste is used which contains tin salt or sulfoxylates as discharge agent.

3. Process as claimed in claim 1, wherein the discharge printing paste is applied to the said dyeing without intermediate drying.

* * * * *